US006419416B1

(12) United States Patent
Tomoda

(10) Patent No.: US 6,419,416 B1
(45) Date of Patent: Jul. 16, 2002

(54) FILING DEVICE

(75) Inventor: Hideyuki Tomoda, Osaka (JP)

(73) Assignee: Tomoda Giken Industry Co., Ltd. (JP)

( * ) Notice: Subject to any disclaimer, the term of this patent is extended or adjusted under 35 U.S.C. 154(b) by 0 days.

(21) Appl. No.: 09/844,219

(22) Filed: Apr. 27, 2001

(30) Foreign Application Priority Data

Oct. 19, 2000 (JP) ..... 2000-318661
Feb. 1, 2001 (JP) ..... 2001-024989

(51) Int. Cl.[7] ..... B42F 13/06

(52) U.S. Cl. ..... 402/18; 24/67 R; 24/67.11; 281/27.1; 402/70; 402/73; 402/80 R; 402/500; D19/26

(58) Field of Search ..... 24/67 R, 67.1, 24/67.9, 67.11; 281/27.1, 28, 36, 38, 46, 47; 402/18, 46, 55, 56, 63, 64, 68, 70, 73, 75, 79, 80 R, 500; D19/26, 27

(56) References Cited

U.S. PATENT DOCUMENTS 3,351,065 A * 11/1967 Roush
4,919,557 A * 4/1990 Podosek ..... 402/41
5,358,125 A * 10/1994 Blessing ..... 211/46
5,405,209 A * 4/1995 Johns et al. ..... 402/28
5,433,546 A * 7/1995 Kershaw ..... 402/79
5,772,348 A * 6/1998 To ..... 402/36
5,888,011 A * 3/1999 Reinbold, Jr. ..... 402/70

* cited by examiner

*Primary Examiner*—A. L. Wellington
*Assistant Examiner*—Monica Carter
(74) *Attorney, Agent, or Firm*—Mark Kusner; Michael A. Jaffe

(57) ABSTRACT

It is an object of the present invention to provide a filing device which includes simplified binding elements for removably binding a plurality of folder bags of a synthetic resin, and allows for easy attachment of the binding elements to a file cover thereof. The filing device comprises: a file cover including a front cover portion, a back cover portion, and aspine provided between the front and back cover portions; and a binding member fixed onto an inner side of the spine of the file cover and including an elongated base plate, a plurality of binding elements provided parallel to each other at predetermined intervals along the length of the base plate on an inner side of the base plate as projecting perpendicularly to the base plate, and hooks extending outwardly from longitudinally opposite ends of the base plate and bent into a U-shape so as to be hooked onto longitudinally opposite ends of the spine of the file cover. The binding elements respectively have generally inverted-U-shaped flanges which are engageable with engagement portions provided as incisions in an edge portion of a folder bag at the predetermined intervals.

19 Claims, 15 Drawing Sheets

FILING DEVICE

TECHNICAL FIELD

The present invention relates to a filing device for removably binding a plurality of folder bags of a synthetic resin sheet for accommodating documents, photographs, business cards, cards, magnetic disks or the like.

BACKGROUND ART

Various filing devices are conventionally known which are capable of removably binding a plurality of folder bags of a synthetic resin for accommodating documents, business cards, cards or the like. One exemplary filing device comprises a front cover, a back cover, a spine provided between the front cover and the back cover, and a plurality of openable binder rings provided on an inner side of the spine and each adapted to be closed when the filing device is closed.

This arrangement, however, requires a mechanism for opening and closing the respective binder rings, thereby complicating the construction of the filing device. In addition, the respective binder rings are collectively fixed onto the inner side of the spine by pins or the like, so that a fixture is required for fixing the binder rings onto the spine. This disadvantageously increases the costs.

DISCLOSURE OF THE INVENTION

In order to solve the aforesaid problems, it is an object of the present invention to provide a filing device which includes binding elements having a simpler construction than the conventional openable binder rings for removably binding a plurality of folder bags of a synthetic resin, and allows for easy attachment of the binding elements to a file cover thereof.

To attain the aforesaid object, the present invention has the following features.

In accordance with a first feature of the present invention, there is provided a filing device for removably binding a plurality of folder bags of a synthetic resin each having engagement portions provided as incisions in an edge portion thereof at predetermined intervals, the filing device comprising: a file cover including a front cover portion, a back cover portion, and a spine provided between the front and back cover portions; and a binding member including an elongated base plate, a plurality of binding elements provided parallel to each other at the predetermined intervals along the length of the base plate on an inner side of the base plate as projecting perpendicularly to the base plate, and a pair of hooks extending outwardly from longitudinally opposite ends of the base plate in a U-shape, the binding member being a unitary component formed of a synthetic resin; wherein the binding member is fixed onto an inner side of the file cover along a longitudinal edge of the spine with the pair of hooks being hooked onto opposite edges of the file cover in the vicinity of the longitudinal edge of the spine; wherein the binding elements of the binding member respectively have generally inverted-U-shaped flanges which are engageable with the engagement portions of the folder bags.

The binding member may be fixed onto an inner side of the spine of the file cover with the pair of hooks being hooked onto longitudinally opposite ends of the spine.

The binding member may be fixed onto an inner side of at least one of the front and back cover portions of the file cover along the longitudinal edge of the spine with the pair of hooks being hooked onto opposite edges of the at least one cover portion in the vicinity of the longitudinal edge of the spine.

The spine of the file cover may have a pair of cut-away portions provided at the longitudinally opposite ends thereof and having the same width as the base plate of the binding member. In this case, the binding member is fixed onto the inner side of the spine with the pair of hooks being respectively fitted in the pair of cut-away portions.

The at least one cover portion of the file cover may have a pair of cut-away portions provided on the opposite edges thereof in the vicinity of the longitudinal edge of the spine and having the same width as the base plate of the binding member. In this case, the binding member is fixed onto the inner side of the at least one cover portion of the file cover along the longitudinal edge of the spine with the pair of hooks being respectively fitted in the pair of cut-away portions.

The spine of the file cover may be formed with at least one engagement hole, which has a hole portion and a linear slot extending from the hole portion parallel to the longitudinal edge of the spine and having a smaller width than the hole portion, and the base plate of the binding member may have at least one engagement projection projecting from an outer side thereof, the engagement projection having a stem fitted in the linear slot of the engagement hole of the spine and an engagement plate provided at a distal end of the stem and having a width smaller than the width of the hole portion and greater than the width of the linear slot. In this case, the binding member is fixed onto the inner side of the spine of the file cover with the pair of hooks being respectively hooked onto the longitudinally opposite ends of the spine and with the engagement projection of the binding member being fitted in the engagement hole of the spine.

The at least one cover portion of the file cover may have at least one engagement hole formed therein in the vicinity of the longitudinal edge of the spine, the engagement hole having a hole portion and a linear slot extending from the hole portion parallel to the longitudinal edge of the spine and having a smaller width than the hole portion, and the base plate of the binding member may have at least one engagement projection projecting from an outer side thereof, the engagement projection having a stem fitted in the linear slot of the engagement hole of the at least one cover portion and an engagement plate provided at a distal end of the stem and having a width smaller than the width of the hole portion and greater than the width of the linear slot. In this case, the binding member is fixed onto the inner side of the at least one cover portion of the file cover along the longitudinal edge of the spine with the pair of hooks being respectively hooked onto the opposite edges of the at least one cover portion in the vicinity of the longitudinal edge of the spine and with the engagement projection of the binding member being fitted in the engagement hole of the at least one cover portion.

The linear slot of the engagement hole may extend from the center of the hole portion parallel to the longitudinal edge of the spine.

The hole portion of the engagement hole may be of a round shape, and the linear slot of the engagement hole may extend tangentially from the hole portion parallel to the longitudinal edge of the spine.

The spine of the file cover may be formed with at least one engagement hole, and the base plate of the binding member may have at least one engagement projection projecting from an outer side thereof, the engagement projection having a stem and an engagement plate provided at a distal end of the stem and having a width smaller than the width of the engagement hole of the spine and greater than the width of the stem. In this case, the binding member is fixed onto the inner side of the spine of the file cover with the engagement projection of the binding member engaged with the engagement hole of the spine by movement of the base plate and with the pair of hooks being respectively hooked onto the longitudinally opposite ends of the spine.

The at least one cover portion of the file cover has at least one engagement hole formed therein in the vicinity of the longitudinal edge of the spine, and the base plate of the binding member may have at least one engagement projection projecting from an outer side thereof, the engagement projection having a stem and an engagement plate provided at a distal end of the stem and having a width smaller than the width of the engagement hole of the at least one cover portion and greater than the width of the stem. In this case, the binding member is fixed onto the inner side of the at least one cover portion of the file cover along the longitudinal edge of the spine with the engagement projection of the binding member engaged with the engagement hole of the at least one cover portion by movement of the base plate and with the pair of hooks being respectively hooked onto the opposite edges of the at least one cover portion in the vicinity of the longitudinal edge of the spine.

In accordance with a second feature of the present invention, there is provided a filing device for removably binding a plurality of folder bags of a synthetic resin each having engagement portions provided as incisions in an edge portion thereof at predetermined intervals, the filing device comprising: a file cover including a front cover portion, a back cover portion, and a spine provided between the front and back cover portions, the file cover having a plurality of engagement holes formed therein alongside a longitudinal edge of the spine, the engagement holes each having a hole portion, and a linear slot extending from the hole portion parallel to the longitudinal edge of the spine and having a smaller width than the hole portion; and a binding member including an elongated base plate, a plurality of binding elements provided parallel to each other at the predetermined intervals along the length of the base plate on an inner side of the base plate as projecting perpendicularly to the base plate, and a plurality of engagement projections provided on an outer side of the base plate along the length of the base plate, the binding member being a unitary component formed of a synthetic resin, the engagement projections each having a stem fitted in the linear slot of the engagement hole and an engagement plate provided at a distal end of the stem and having a width smaller than the width of the hole portion and greater than the width of the linear slot; wherein the binding member is fixed onto an inner side of the file cover along the longitudinal edge of the spine with the engagement projections being respectively fitted in the engagement holes; wherein the binding elements of the binding member respectively have generally inverted-U-shaped flanges which are engageable with the engagement portions of the folder bags.

The plurality of engagement holes may be formed in the spine of the file cover along the length thereof. In this case, the binding member is fixed onto an inner side of the spine.

The plurality of engagement holes may be formed in at least one of the front and back cover portions of the file cover alongside the longitudinal edge of the spine. In this case, the binding member is fixed onto an inner side of the at least one cover portion along the longitudinal edge of the spine.

The linear slot of the engagement hole may extend from the center of the hole portion parallel to the longitudinal edge of the spine.

The hole portion of the engagement hole may be of a round shape, and the linear slot of the engagement hole may extend tangentially from the hole portion parallel to the longitudinal edge of the spine.

In accordance with a third feature of the present invention, there is provided a filing device for removably binding a plurality of folder bags of a synthetic resin each having engagement portions provided as incisions in an edge portion thereof at predetermined intervals, the filing device comprising: a file cover including a front cover portion, a back cover portion, and a spine provided between the front and back cover portions, the file cover having a plurality of engagement holes formed therein alongside a longitudinal edge of the spine; and a binding member including an elongated base plate, a plurality of binding elements provided parallel to each other at the predetermined intervals along the length of the base plate on an inner side of the base plate as projecting perpendicularly to the base plate, and a plurality of engagement projections provided on an outer side of the base plate along the length of the base plate, the binding member being a unitary component formed of a synthetic resin, the engagement projection each having a stem and an engagement plate provided at a distal end of the stem and having a width smaller than the width of the engagement hole and greater than the width of the stem; wherein the binding member is fixed onto an inner side of the file cover along the longitudinal edge of the spine with the engagement projections respectively engaged with the engagement holes by movement of the base plate;

wherein the binding elements of the binding member respectively have generally inverted-U-shaped flanges which are engageable with the engagement portions of the folder bags.

The plurality of engagement holes may be formed in the spine of the file cover along the length thereof. In this case, the binding member is fixed onto an inner side of the spine.

The plurality of engagement holes may be formed in at least one of the front and back cover portions of the file cover alongside the longitudinal edge of the spine. In this case, the binding member is fixed onto an inner side of the at least one cover portion along the longitudinal edge of the spine.

With the aforesaid arrangements, the binding elements for removably binding the plurality of folder bags of the synthetic resin have a simpler construction than the conventional openable binder rings, and the binding member including the binding elements can easily be fixed onto the spine or onto the at least one cover portion along the spine. Thus, a less expensive filing device can be provided.

DETAILED DESCRIPTION OF THE EMBODIMENTS

Figure 1:
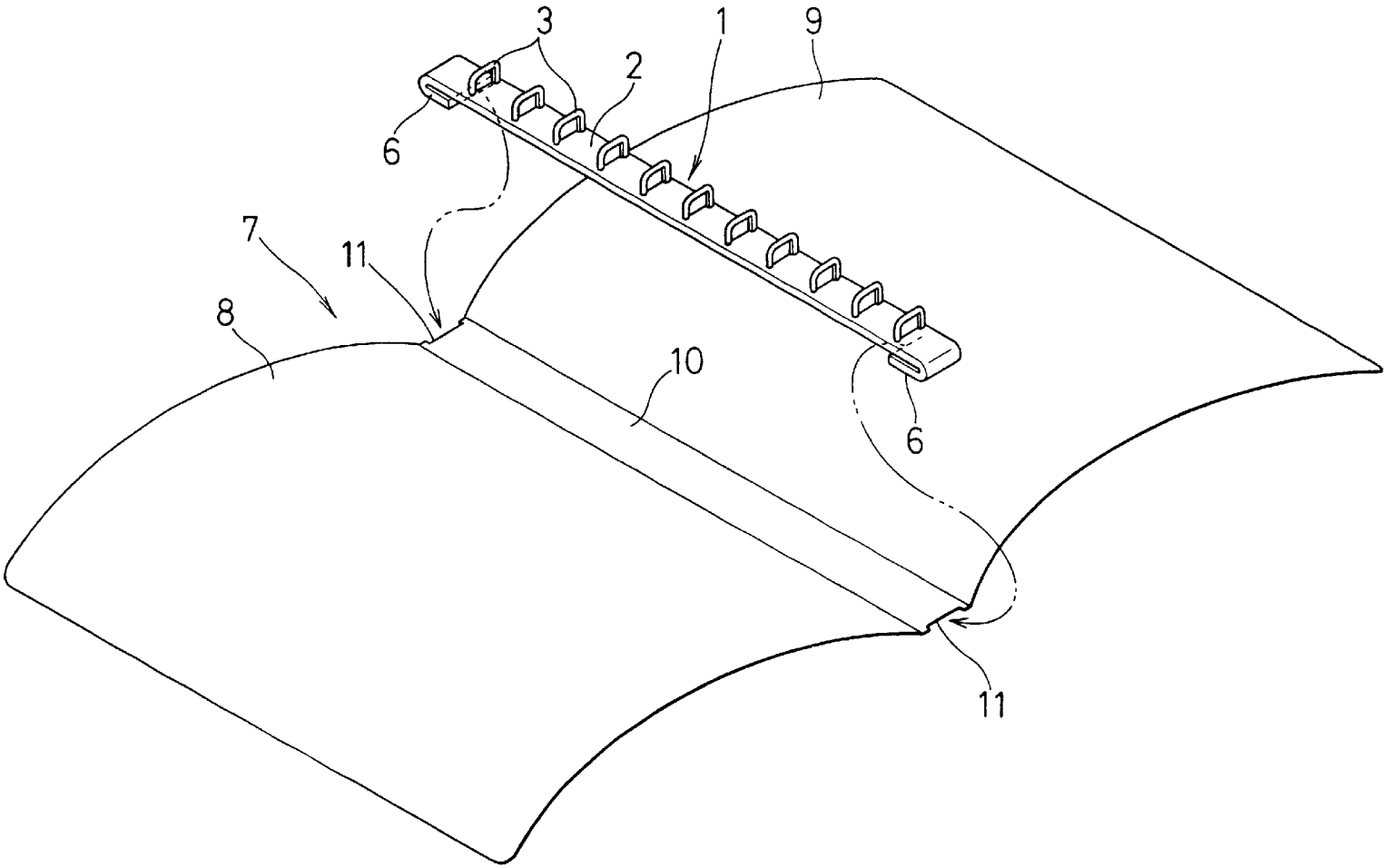
FIG. 1 is an exploded perspective view of a filing device according to a first embodiment of the present invention.
Figure 2:
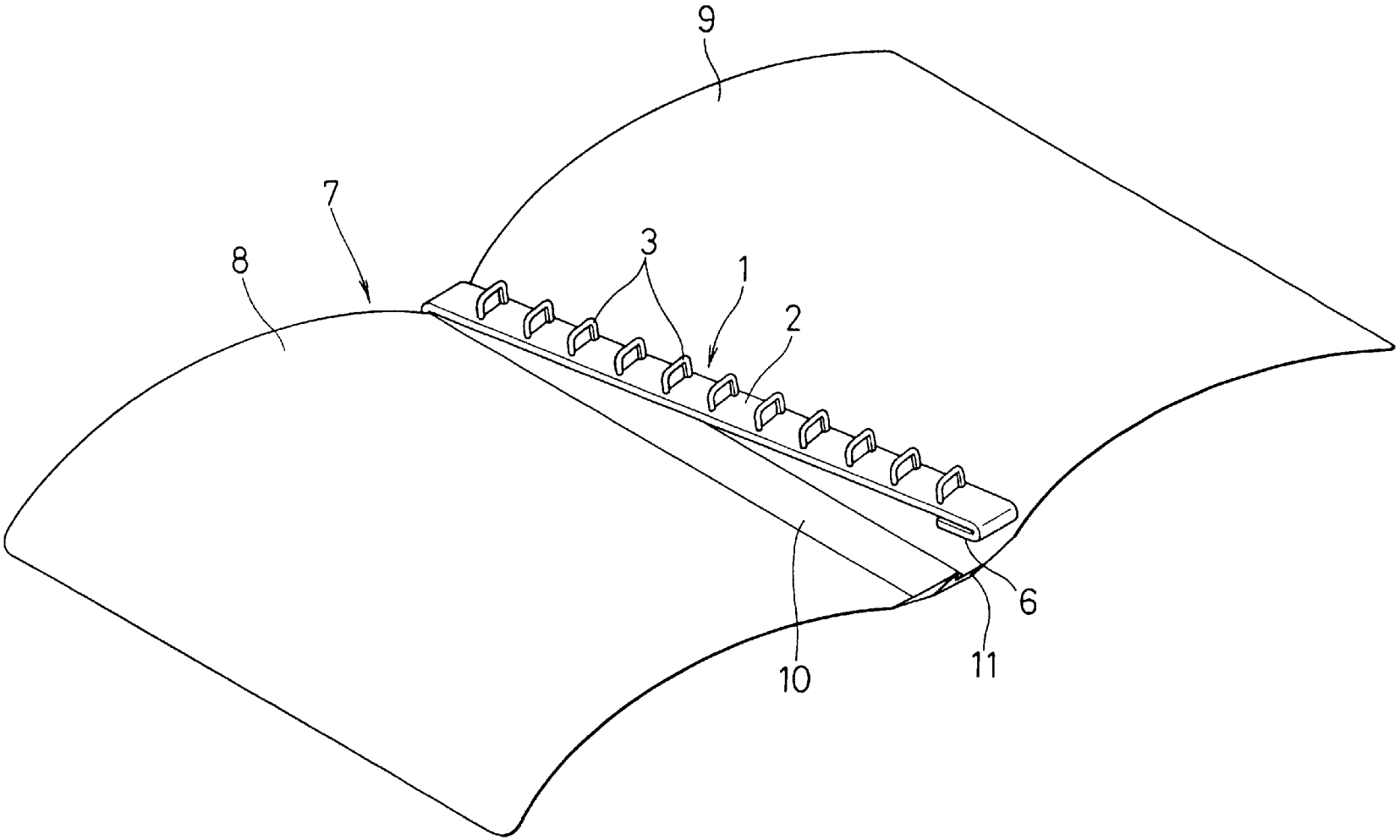
FIG. 2 is a perspective view for explaining how to attach a binding member to a spine of a file cover in accordance with the first embodiment.
Figure 3:
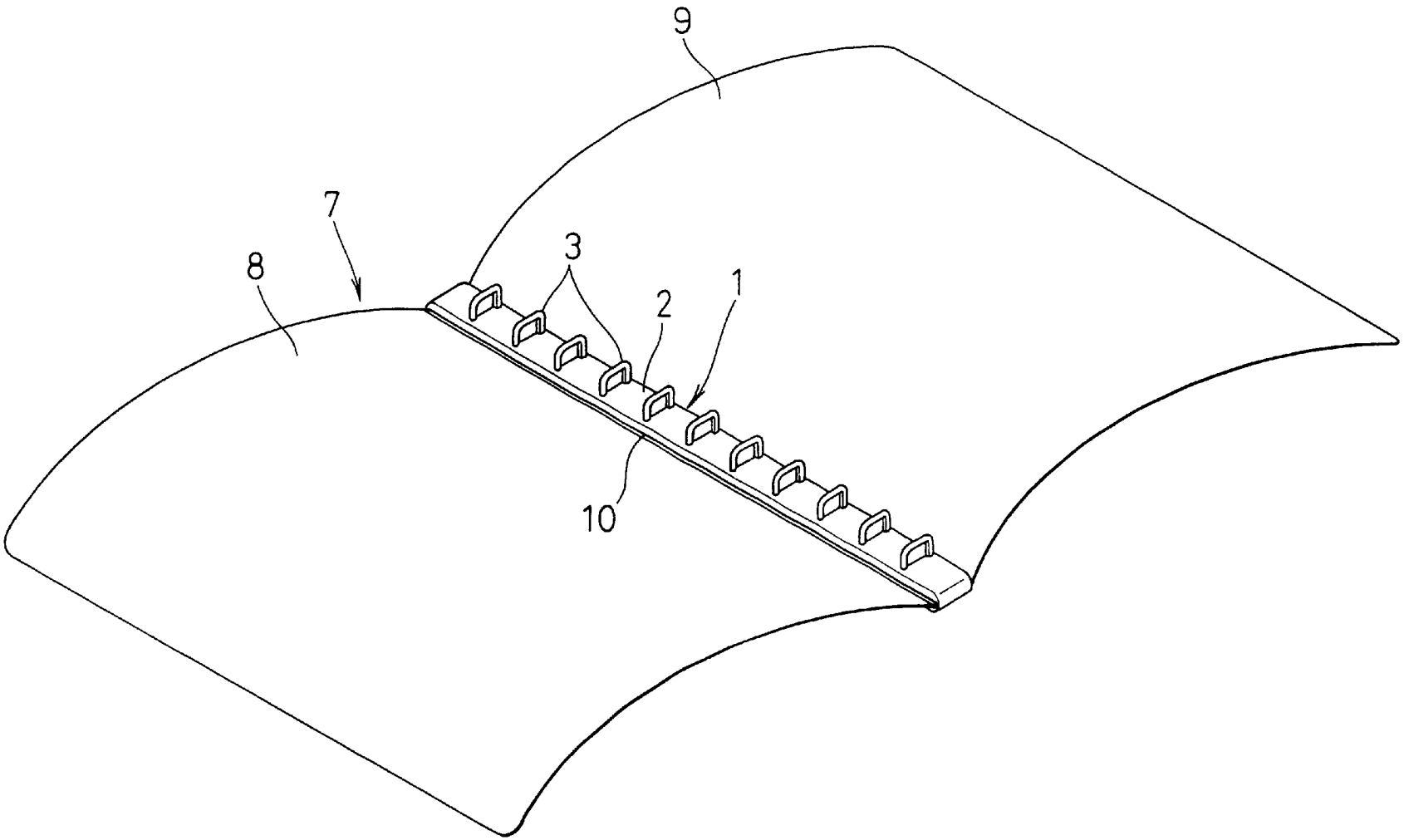
FIG. 3 is a perspective view illustrating the filing device in an open state with the binding member fixed onto the spine of the file cover in accordance with the first embodiment.
Figure 4:
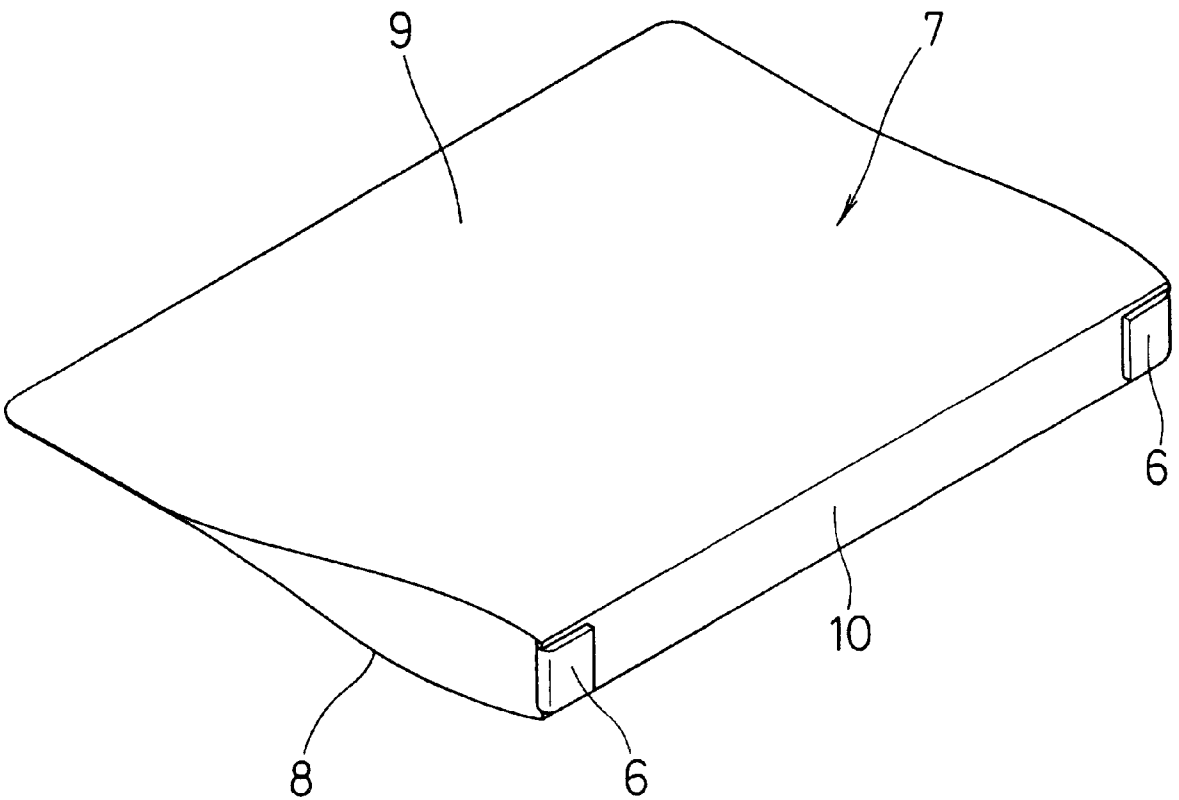
FIG. 4 is a perspective view-illustrating the filing device in a closed state with the binding member fixed onto the spine of the file cover in accordance with the first embodiment.

FIGS. 1 to 6 illustrate a first embodiment of the present invention.

As shown in FIGS. 1 to 6, a filing device according to the first embodiment comprises a binding member 1 and a file cover 7. The binding member 1 is a unitary component formed of a synthetic resin, which includes an elongated base plate 2, and binding elements 3 provided on the base plate 2 at predetermined intervals along the length of the base plate 2. The binding elements 3 of the binding member 1 each have a generally inverted-U-shape and each include a plate portion 4 projecting upright from the base plate 2 and having round upper corners (as seen when the binding member 1 is placed horizontally on a desk or the like), and a flange 5 projecting in opposite directions perpendicularly from a peripheral edge of the plate portion 4 and having a semicircular cross section of a diameter greater than the thickness of the plate portion 4. The binding elements 3 are arranged parallel to each other along the length of the base plate 2 as projecting perpendicularly from an inner side of the base plate 2. The binding member 1 further includes a pair of hooks 6 extending outwardly from longitudinally opposite ends of the base plate 2 in a U-shape. The hooks 6 of the binding member 1 are hooked onto longitudinally opposite ends of a spine of the file cover 7 to be described later.

The file cover 7 includes a front cover portion 8, a back cover portion 9, and a spine 10 provided between the front cover portion 8 and the back cover portion 9. The front and back cover portions 8, 9 and the spine 10 of the file cover 7 are unitarily formed of a synthetic resin. The binding member 1 is fixed onto an inner side of the spine 10 of the file cover 7.

More specifically, the spine 10 has cut-away portions 11 provided in the longitudinally opposite ends thereof and having the same width as the base plate 2 of the binding member 1. The hooks provided at the longitudinally opposite ends of the base plate 2 of the binding member 1 are hooked onto the longitudinally opposite ends of the spine 10 as fitted in the cut-away portions 11 of the spine 10, whereby the binding member 1 is fixed onto the inner side of the spine 10.

A plurality of folder bags 12 of a synthetic resin sheet for accommodating document are removably bound to the binding elements 3 of the binding member 1 fixed onto the inner side of the spine 10 of the file cover 7. An explanation will briefly be given to the folder bag 12. The folder bag 12 is of a rectangular plan shape, and has a spot-fused edge portion 13 formed with a multiplicity of fused spots by ultrasonic fusion bonding. More specifically, the spot-fused edge portion 13 of the folder bag 12 has a three- or four-layered structure formed by folding an edge portion of a synthetic resin sheet and spot-fusing the folded edge portion. The folder bag 12 has a plurality of generally T-shaped incised engagement portions 14 provided as file engagement means in the spot-fused edge portion 13 at predetermined intervals along the length of the edge portion 13. The folder bag 12 has an opening 15 along a top edge thereof (as viewed when the folder bag is held vertically) through which a document is put in and out of the folder bag 12.

Figure 5:
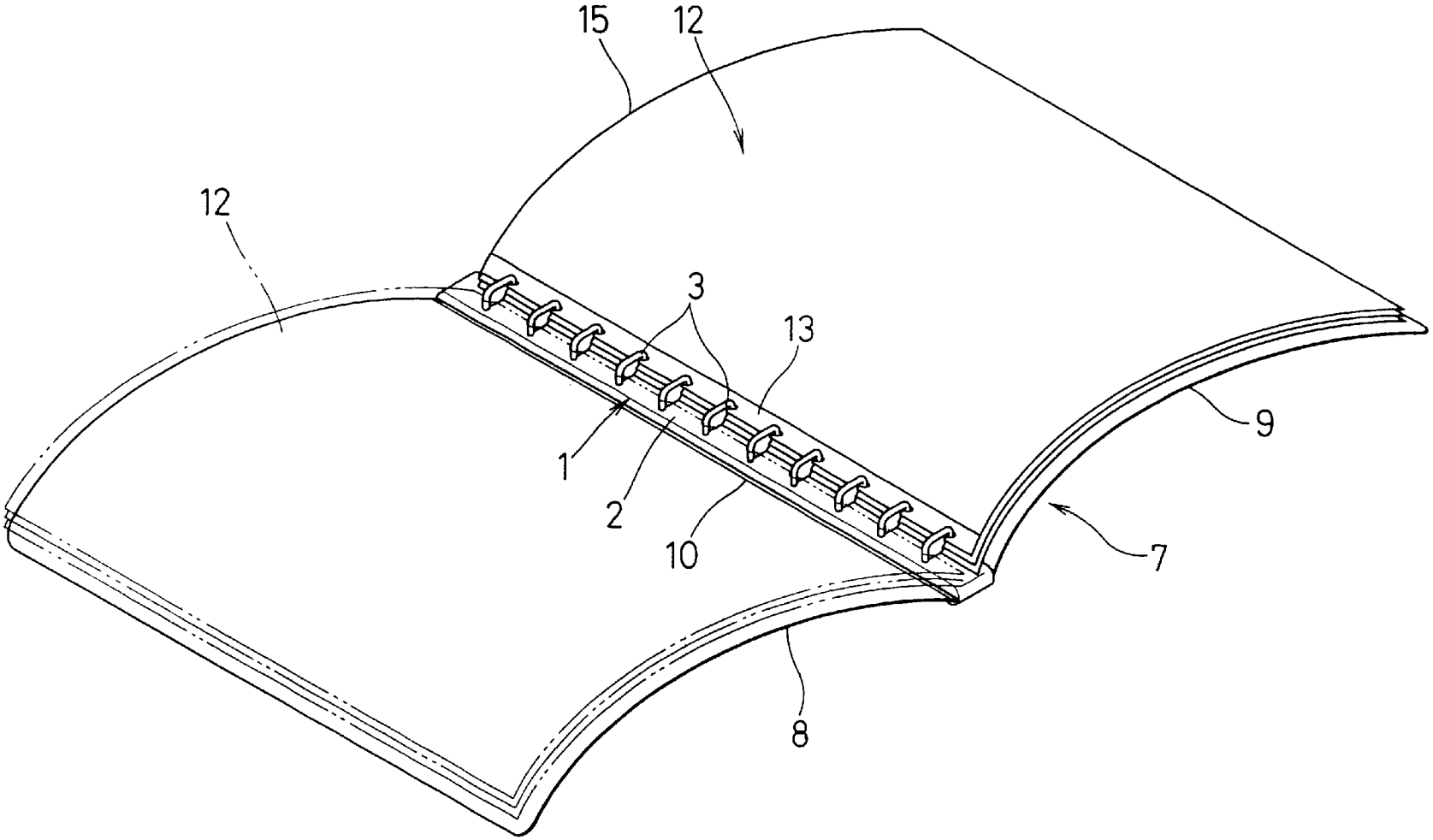
FIG. 5 is a perspective view illustrating the filing device with a plurality of folder bags bound to binding elements of the binding member fixed onto the spine of the file cover in accordance of the first embodiment.
Figure 6:
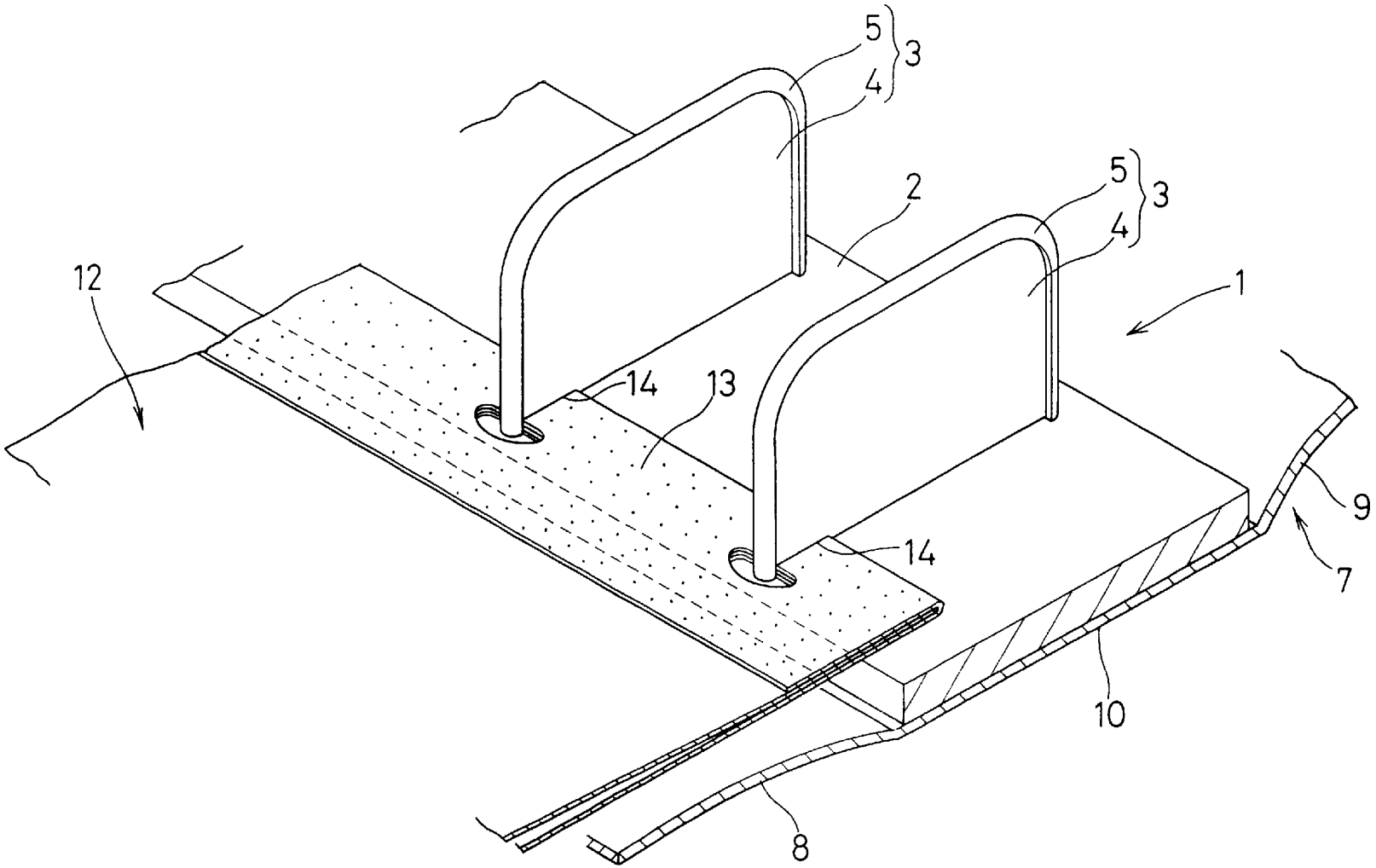
FIG. 6 is an enlarged partial perspective view illustrating a state where a folder bag is bound to the binding elements of the binding member fixed onto the spine of the file cover in accordance of the first embodiment.
Figure 7:
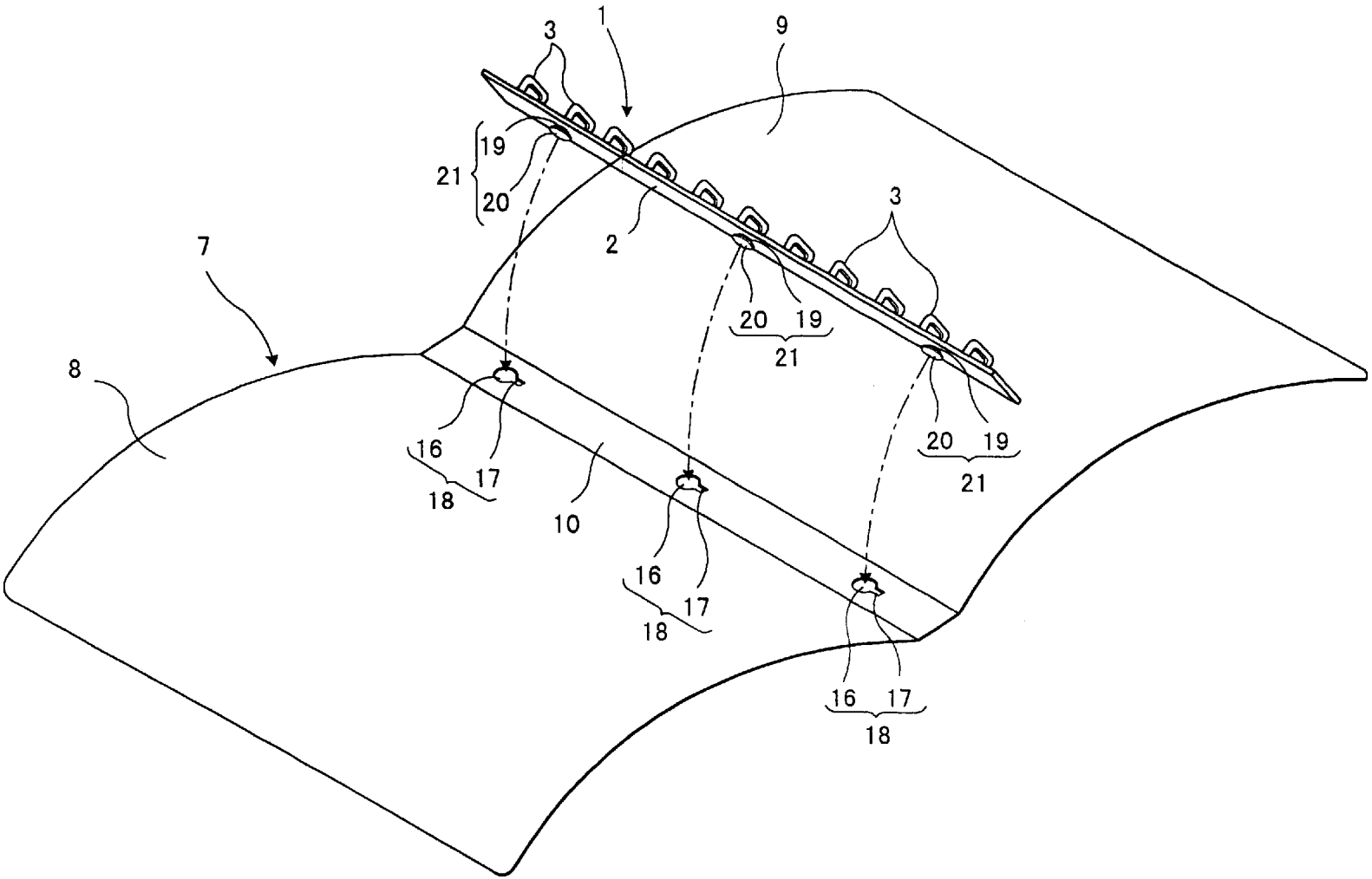
FIG. 7 is an exploded perspective view of a filing device according to a second embodiment of the present invention.
Figure 8:
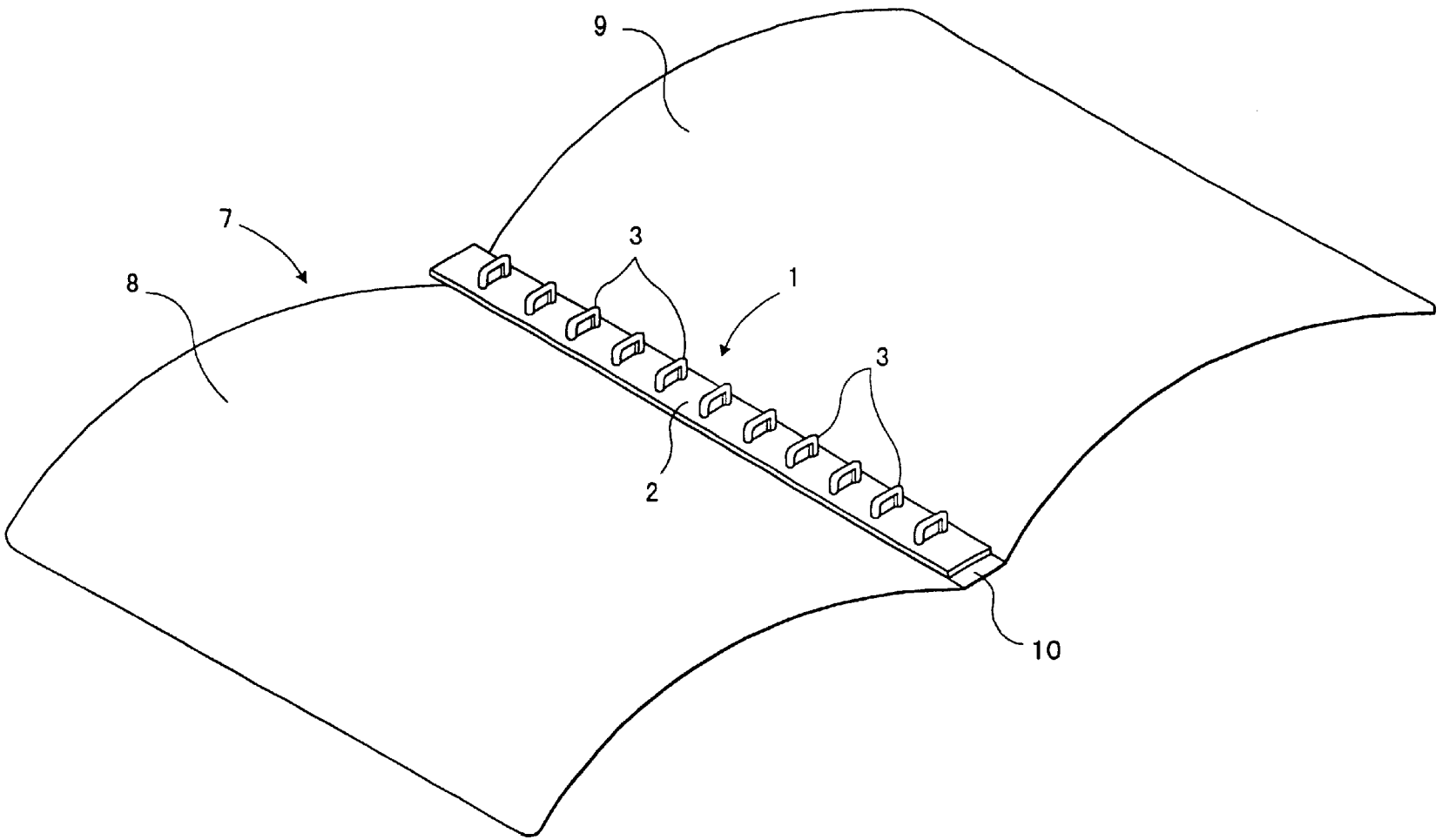
FIG. 8 is a perspective view for explaining how to attach a binding member to a spine of a file cover in accordance with the second embodiment.
Figure 9:
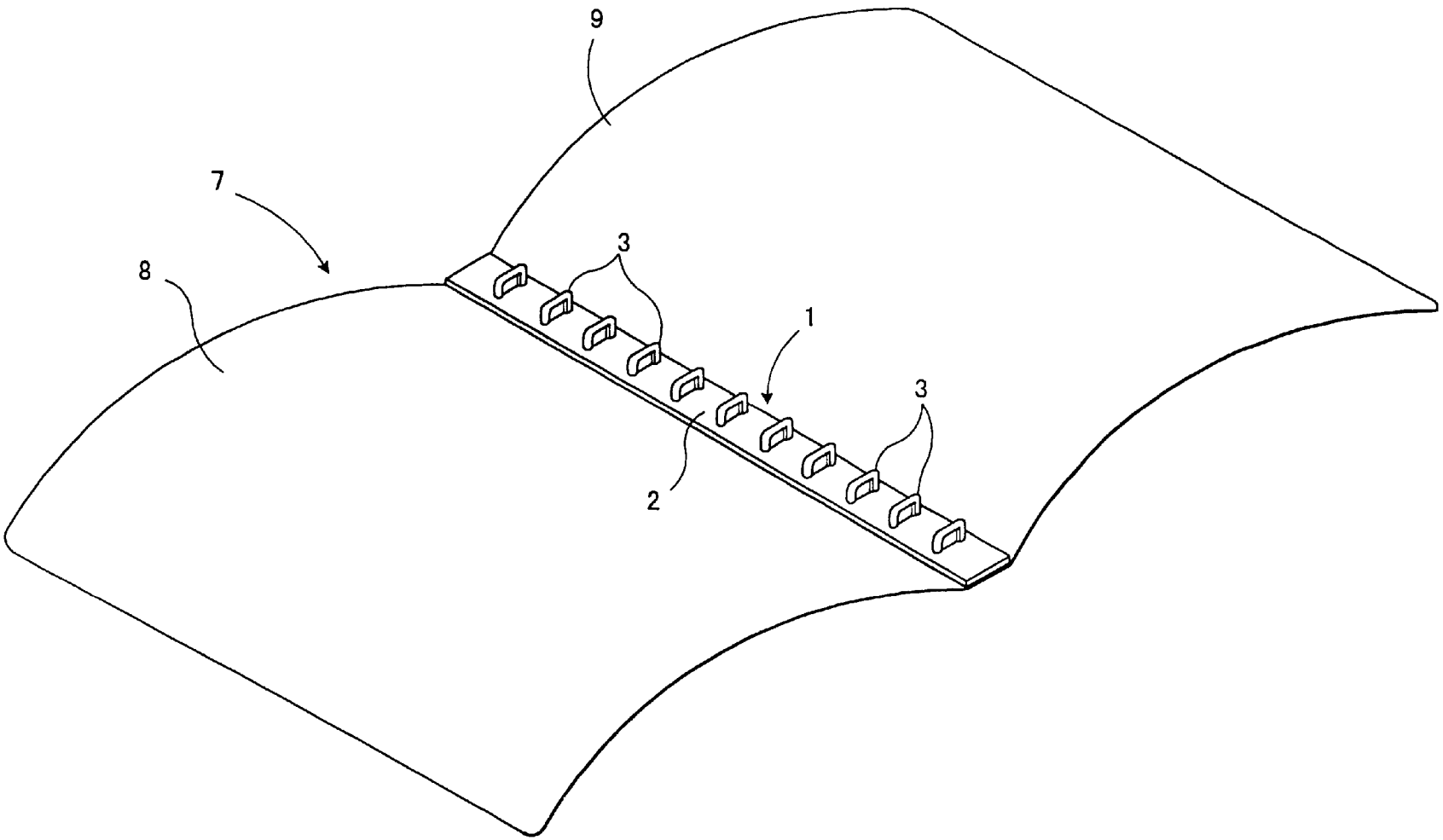
FIG. 9 is a perspective view illustrating the filing device in an open state with the binding member fixed onto the spine of the file cover in accordance with the second embodiment.
Figure 10:
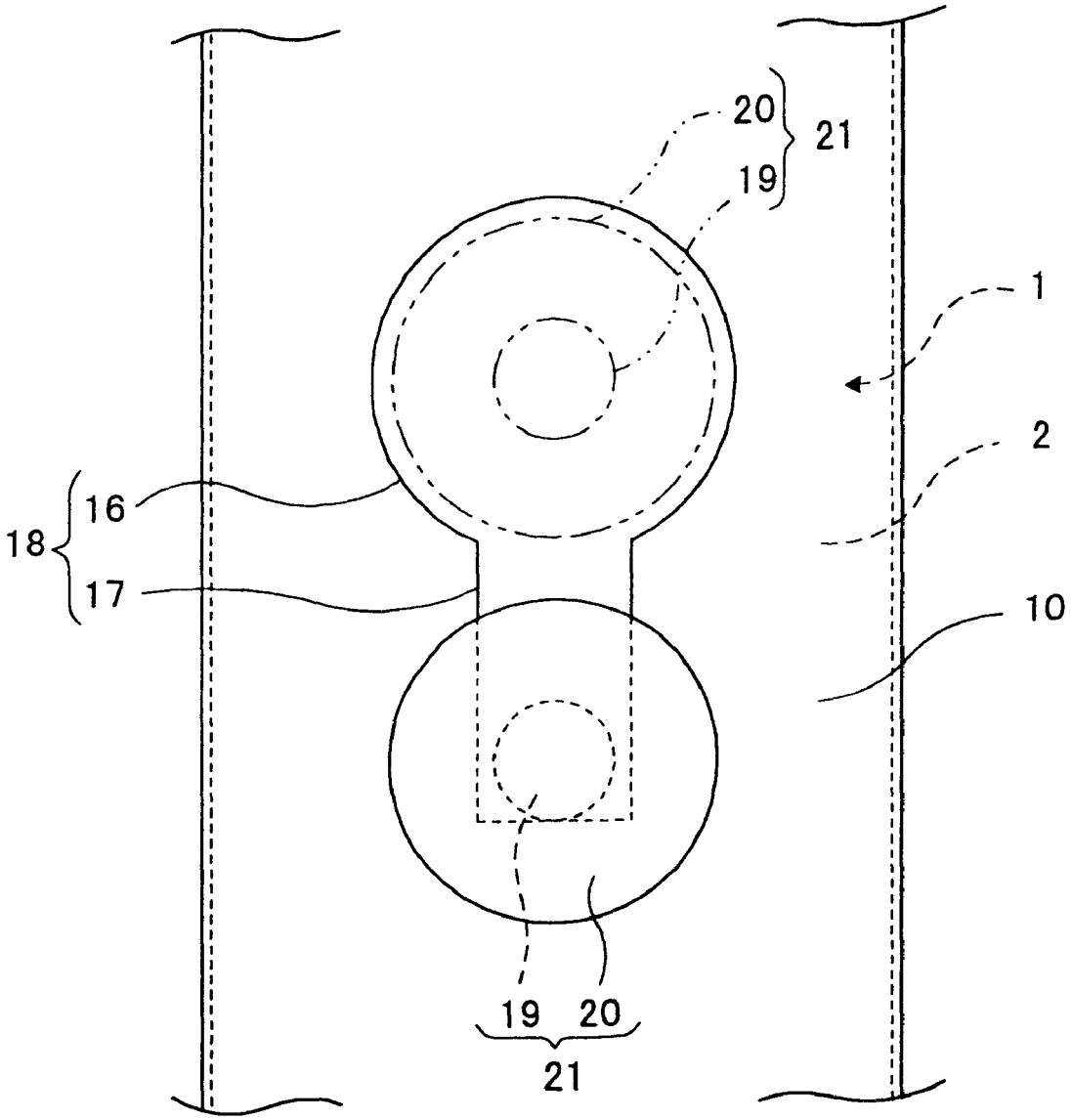
FIG. 10 is an enlarged partial view illustrating a state where the binding member is fixed onto the spine of the file cover, as seen externally of the spine, in accordance with the second embodiment.
Figure 11:
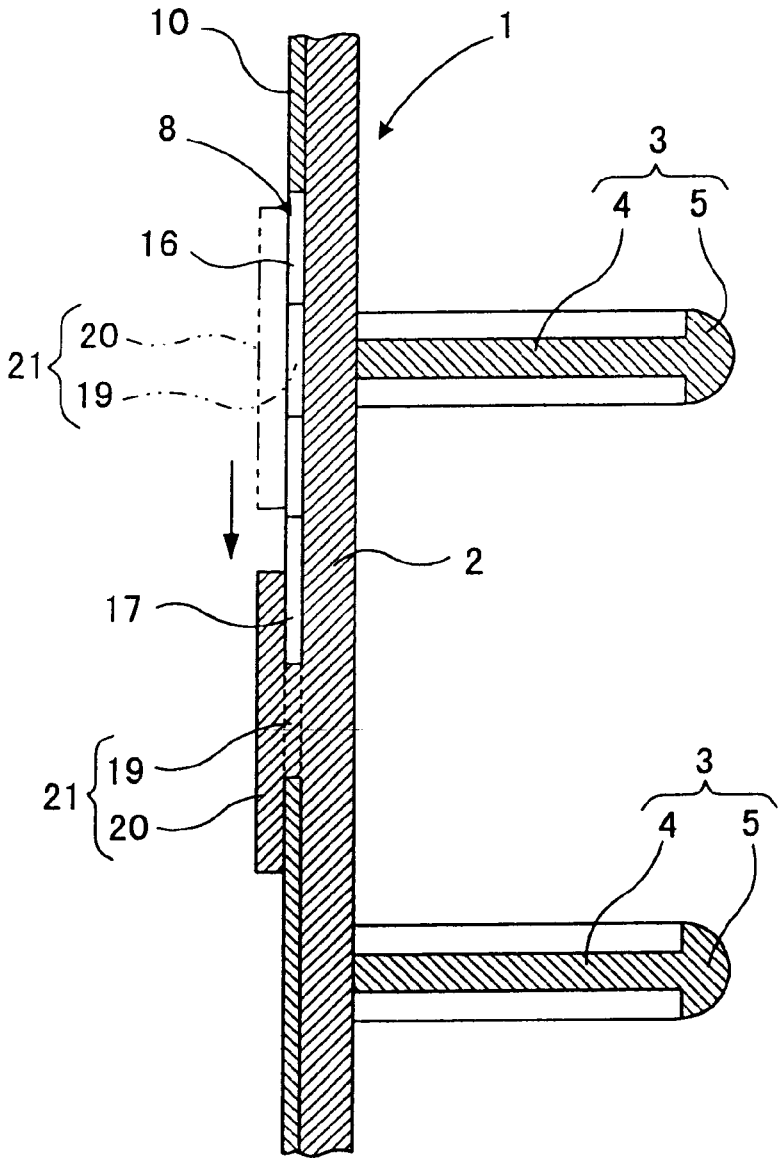
FIG. 11 is an enlarged partial sectional view illustrating the state where the binding member is fixed onto the spine of the file cover in accordance with the second embodiment.

With this arrangement, the plurality of folder bags 12 are removably bound to the binding member 1 with the T-shaped incised engagement portions 14 (as the file engagement means) being engaged with the flanges 5 of the binding elements 3. That is, the T-shaped incised engagement portions 14 can easily be engaged with and disengaged from the flanges 5 of the binding elements 3 by the resiliency of the engagement portions. The number of the binding elements 3 is not limited to that shown in the figures, but may be greater or smaller than that number. The number of the engagement portions 14 of the folder bag 12 is determined as corresponding to the number of the binding elements 3. The folder bag 12 is movable along the flanges 5 with the engagement portions 14 thereof being engaged with the flanges 5. Where the front cover portion 8 is opened as shown in FIG. 5, the folder bag 12 is turned between the front cover portion 8 and the back cover portion 9.

While the illustrated embodiment has thus been explained, the embodiment may be modified as follows. For example, the binding elements 3 are not necessarily each required to include the plate portion 4, but may have only the flange 5. In this case, the flange 5 may be a bar or a tube having a generally semicircular cross section. The folder bag 12 has the T-shaped incised engagement portions 14 provided as the file engagement means at the predetermined intervals in the edge portion 13 of the folder bag 12 in the first embodiment but, alternatively, the file engagement means may be constituted by round holes formed at the predetermined intervals in the edge portion 13 of the folder bag 12 and slits (incisions) extending from the centers of the round holes to the adjacent edge of the folder bag 12. The folder, bags to be engaged with the binding elements 3 may be adapted to accommodate not only the documents but also photographs, business cards, cards, magnetic disks or the like. Though not shown, the spine 10 may have a greater width, and two binding members 1 may be provided in juxtaposition on the spine 10.

Although the binding member 1 is fixed onto the inner side of the spine 10 in the illustrated embodiment, the cut-away portions may be formed in opposite edges of the front cover portion 8 or the back cover portion 9 in the vicinity of the spine 10 as having the same width as the base plate 2 of the binding member 1, so that the binding member 1 can be fixed onto an inner side of the front or back cover portion 8, 9 with the hooks 6 of the base plate 2 of the binding member 1 being fitted in the cut-away portions of the front or back cover portion 8, 9. Further, a second binding member having a smaller length than the binding member 1 and including binding elements having the same construction as the binding elements 3 may be fixed onto the front or back cover portion 8, 9 with hooks thereof being fitted in cut-away portions formed in the front or back cover portion 8, 9, so that an index sheet can be engaged with the binding elements of the second binding member.

FIGS. 7 to 10 illustrate a second embodiment of the present invention.

As shown in FIGS. 7 to 10, a filing device according to the second embodiment has substantially the same construction as the filing device according to the first embodiment, except that the binding member 1 is fixed onto the file cover 7 in a different manner. In the first embodiment, the fixing of the binding member 1 onto the file cover 7 is achieved by hooking the hooks 6 (extending outwardly from the longitudinally opposite ends of the base plate 2 of the binding member 1 in a U-shape) onto the opposite ends of the spine 10 of the file cover 7. In the second embodiment, on the contrary, engagement projections 21 provided on an outer side of the base plate 2 of the binding member 1 are engaged with engagement holes 18 formed in the spine 10 of the file cover 7 for fixing the binding member 1 to the inner side of the spine 10 of the file cover 7. More specifically, the engagement holes 18 are formed at widthwise middle positions adjacen[009f] to the longitudinally opposite ends of the spine 10 and at the center of the spine 10, and each include a round hole portion 16 and a linear slot 17 extending from the hole portion 16 along the length of the spine 10 and having a width smaller than the inner diameter (width) of the hole portion 16. The engagement projections 21 are provided at widthwise middle positions adjacent to the longitudinally opposite ends of. the base plate 2 and at the center of the base plate 2 as projecting from the outer side (back side) of the base plate 2 of the binding member 1, and each include a stem 19 to be fitted in the linear slot 17 of the engagement hole 18, and a round engagement plate 20 provided at a distal end of the stem 19 and having a diameter smaller than the inner diameter (width) of the hole portion 16 of the engagement- hole 18 and greater than the width of the linear slot 17. The stem 19 and the engagement plate 20 are formed integrally with the base plate 2 of the binding member 1. The linear slots 17 of the engagement holes 18 are located at the widthwise middle positions of the spine 10 and each extend from the center of the round hole 16 along the length of the spine 10. The stem 19 and the engagement plate 20 are provided in a concentric relation. The other construction is the same as in the first embodiment and the modifications thereof.

When the binding member 1 is to be attached to the inner side of the spine 10 of the file cover 7, the engagement projections 21 provided on the outer side of the binding member 1 are respectively inserted into the hole portions 16 of the engagement holes 18, and then moved into the smaller-width linear slots 17. Thus, the stems 19 of the engagement projections 21 are fitted in the linear slots 17, whereby the binding member 1 is fixed onto the inner side of the spine 10 of the file cover 7. With the engagement projections 21 of the binding member 1 respectively engaged with the engagement holes 18 of the spine 10, opposite longitudinal edges of the binding member 1 can fit along fold lines of the file cover 7 defined along junctures between the spine 10 and the front cover portion 8 and between the spine 10 and the back cover portion 9.

Figure 12:
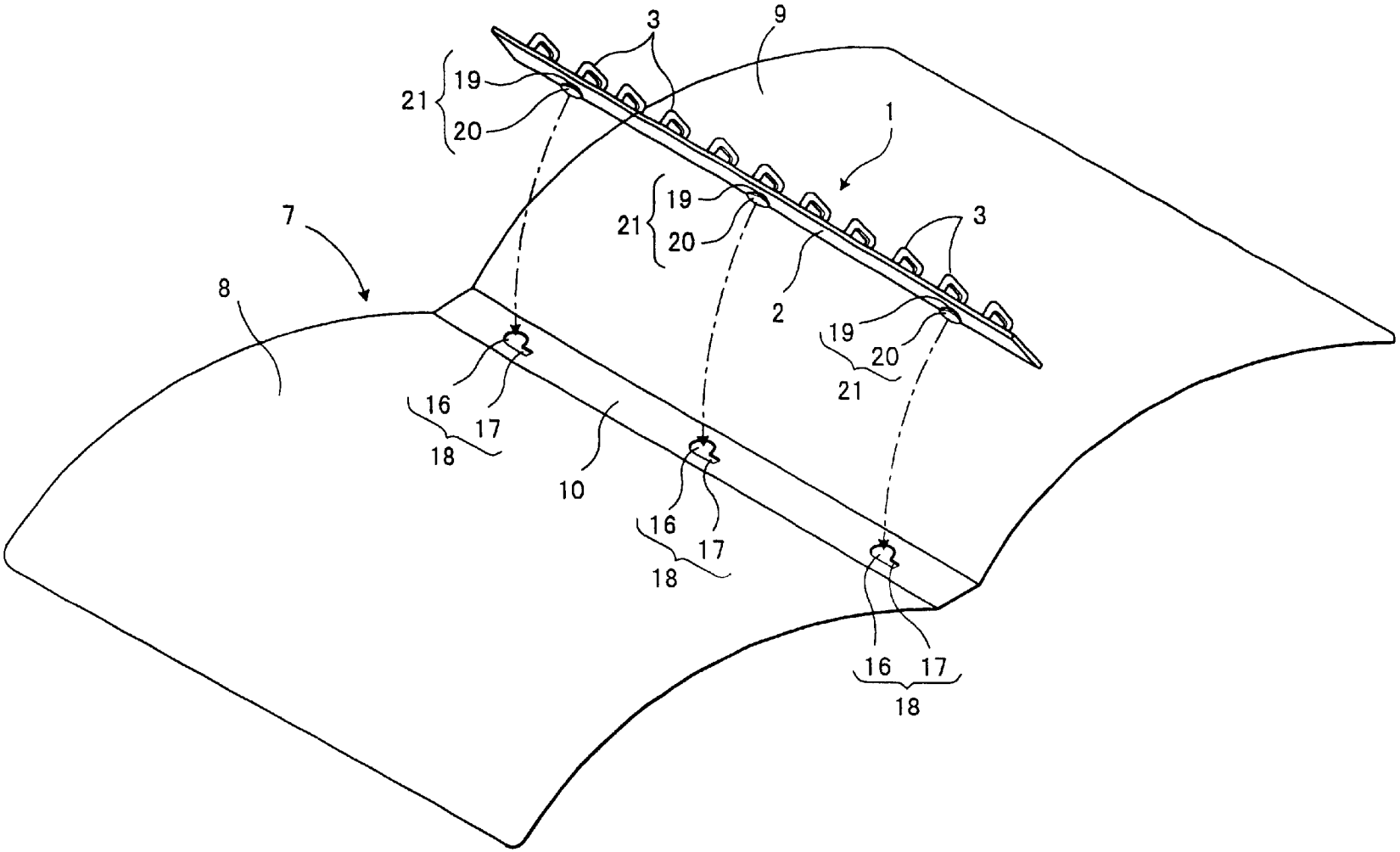
FIG. 12 is an exploded perspective view of a filing device according to a third embodiment of the present invention.
Figure 13:
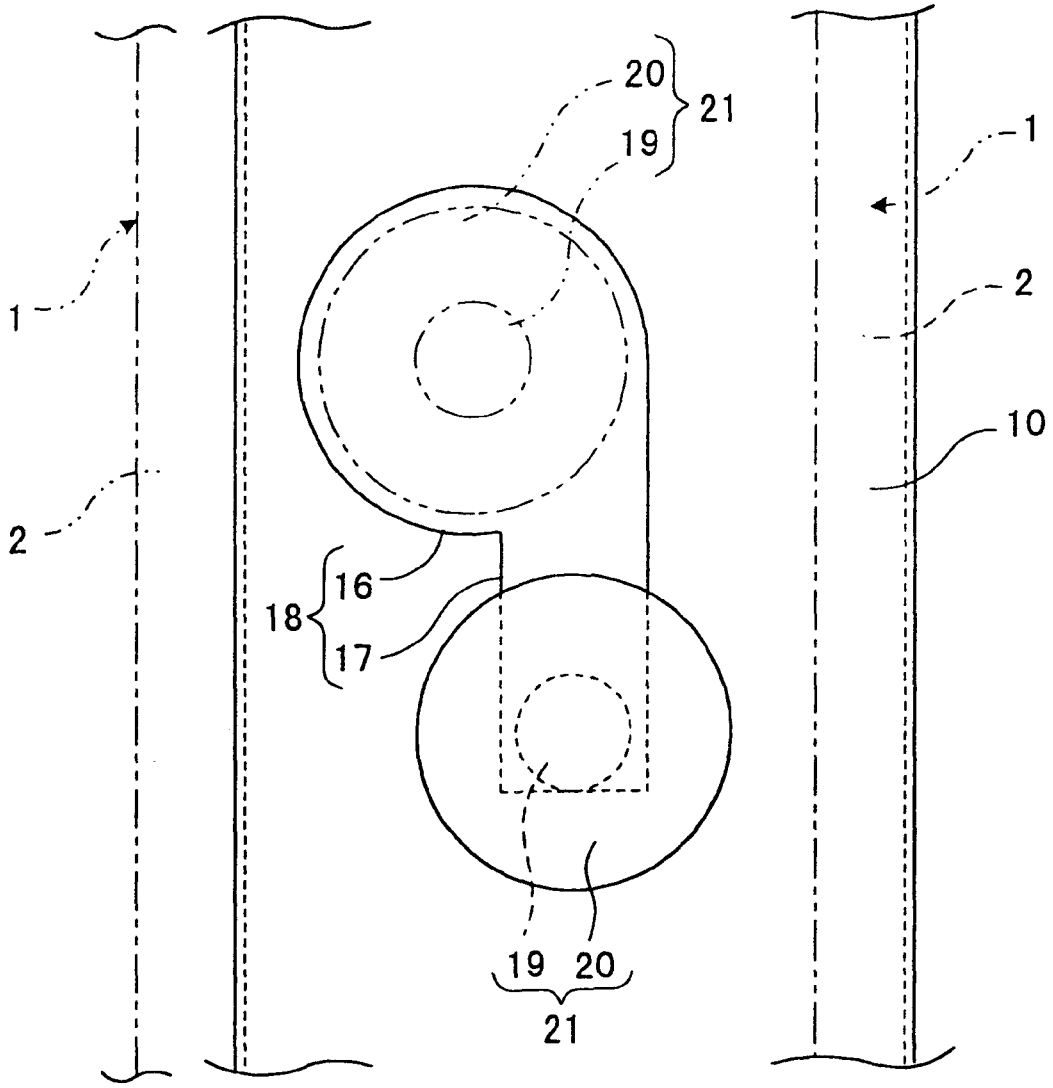
FIG. 13 is an enlarged partial view illustrating a state where a binding member is fixed onto a spine of a file cover, as seen externally of the spine, in accordance with the third embodiment.

FIGS. 12 and 13 illustrate a third embodiment of the present invention.

As shown in FIGS. 12 and 13, a filing device according to the third embodiment has substantially the same construction as the filing device according to the second embodiment except the following point. Although the engagement holes 18 according to the second embodiment are each configured so that the linear slot 17 extends from the center of the round hole portion 16 along the length of the spine 10 and is located at the widthwise middle position of the spine 10, the engagement holes 18 according to the third embodiment are each configured so that the linear slot 17 extends tangentially from the round hole portion 16 along the length of the spine 10 and is located at the widthwise middle position of the spine 10 and the center of the round hole portion 16 is offset from the widthwise middle position of the spine 10. That is, the centers of the round hole portions 16 are offset widthwise from a longitudinal center line of the spine 10, while the linear slots 17 extend tangentially from the round hole portions 16 along the longitudinal center line of the spine 10.

The engagement projections 21 each including the stem 19 and the round engagement plate 20 are disposed in the vicinity of the longitudinally opposite ends of the base plate 2 and at the center of the base plate 2 on the outer side (back side) of the base plate 2 of the binding member 1 with the centers thereof located on a longitudinal center line of the base plate 2 of the binding member 1. When the binding member 1 is to be fixed onto the spine 10 of the file cover 7, the engagement plates 20 of the engagement projections 21 provided on the outer side of the binding member 1 are respectively inserted into the hole portions 16 of the engagement holes 18, and the binding member 1 is moved widthwise and then along the length of the binding member l so that the stems 19 of the engagement projections 21 of the binding member 1 are respectively fitted in the linear slots 17. Thus, the binding member 1 can be fixed onto the inner side of the spine 10 of the file cover 7. The other construction is the same as in the second embodiment and the modifications thereof.

With the stems 19 of the engagement projections 21 of the binding member 1 respectively thus engaged with the linear slots 17 extending tangentially from the round hole portions 16 of the engagement holes 18 along the length of the spine 19, the opposite longitudinal edges of the binding member 1 can fit along the fold lines of the file cover 7 defined along the junctures between the spine 10 and the front cover portion 8 and between the spine 10 and the back cover portion 9. Even if the binding member 1 is inadvertently brought out of the engagement position with respect to the spine 10 to disengage the stems 19 of the engagement projections 21 from the linear slots 17 toward the hole portions 16, the engagement plates 20 of the engagement projections 21 are not allowed to be withdrawn from the hole portions 16 without moving the binding member 1 in a widthwise direction. As described above, the binding member 1 is attached to the inner side of the spine 10 of the file cover 7 with the opposite longitudinal edges of the binding member 1 fitting along the fold lines of the file cover 7 (defined along junctures between the spine 10 and the front cover portion 8 and between the spine 10 and the back cover portion 9) in accordance with the third embodiment. Therefore, the opposite longitudinal edges of, the binding member 1 are restricted by the fold lines of. the file cover 7, so that the binding member 1 is prevented from being disengaged from the spine 10 of the file cover 7.

The third embodiment may be modified as follows. The engagement holes are each configured so that the center of the round hole portion 16 is located on the longitudinal center line of the spine 10 and the linear slot 17 extends tangentially from the round hole portion 16 along the length of the spine 10 to be offset widthwise from the longitudinal center line of the spine 10. On the other hand, the engagement projections 21 are each provided on the binding member 1 with the center thereof being offset widthwise from the longitudinal center line of the binding member 1. The engagement projections 21 of the binding member 1 are respectively brought into engagement with the engagement holes 18 of the spine 10 for fixing the binding member 1 to the inner side of the spine 10 of the file cover 7.

In the second and third embodiments and the modifications thereof, the engagement plates 20 of the engagement projections 21 and the hole portions 16 of the engagement holes 18 each have a round shape. However, the shapes of the engagement plates 20 and the hole portions 16 are not particularly limited, but may be square, rectangular, triangular or oval.

Figure 14:
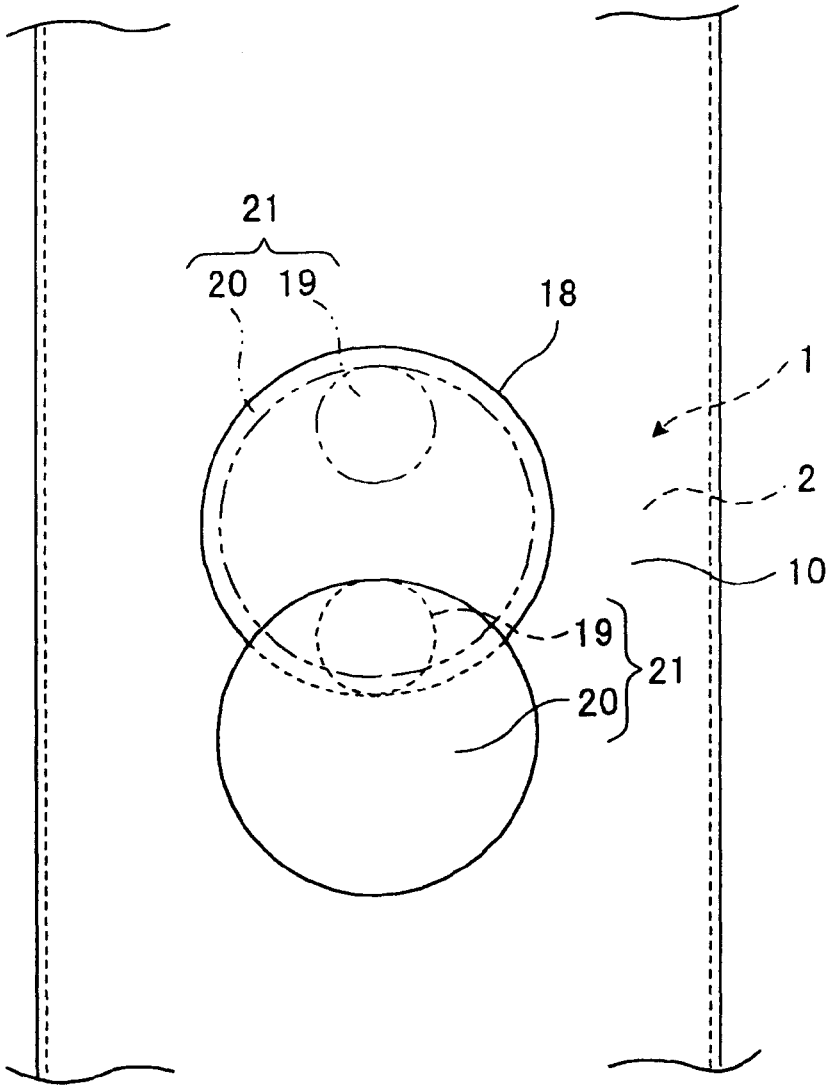
FIG. 14 is an enlarged partial view illustrating a state where a binding member is fixed onto a spine of a file covert as seen externally of the spine, in accordance with a fourth embodiment of the present invention.
Figure 15:
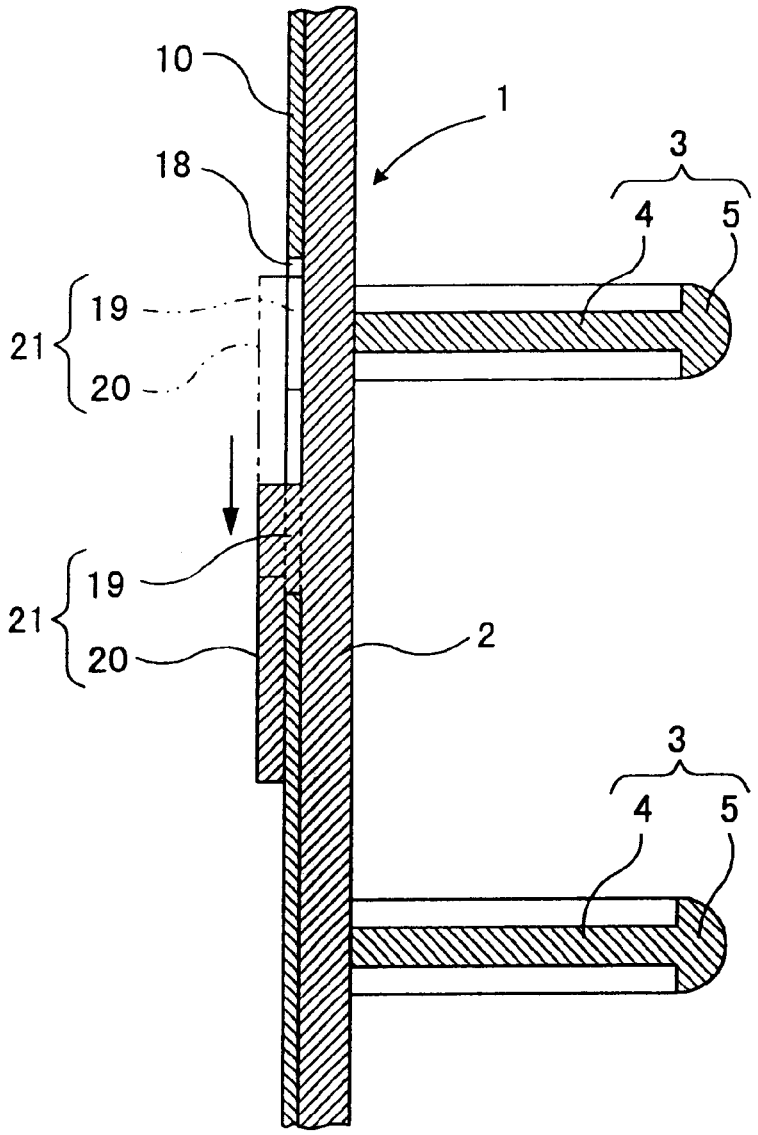
FIG. 15 is an enlarged partial sectional view illustrating the state where the binding member is fixed onto the spine of the file cover in accordance with the fourth embodiment.

FIGS. 14 and 15 illustrate a fourth embodiment of the present invention.

The filing device according to the fourth embodiment has substantially the same construction as the filing devices according to the second and third embodiments, except that the engagement holes 18 are each configured in a different shape as shown in FIGS. 14 and 15. Although the engagement holes 18 arranged along the length of the spine 10 in accordance with the second and third embodiments each include the round hole portion 16 and the linear slot 17 extending from the hole portion 16 along the length of the spine 10 and having a width smaller than the inner diameter (width) of the hole portion 16, the engagement holes 18 according to the fourth embodiment are simple round holes. The engagement projections 21 are arranged along the length of the base plate 2 on the outer side (back side) of the base plate 2 of the binding member 1, and each include an engagement plate 20 having a smaller diameter (width) than the engagement hole 18 and a stem 19 extending from the base plate 2 to the engagement plate 20 and having a smaller width than the engagement plate 20. However, the stem 19 is not concentric with the engagement plate 20 with the center thereof being offset from the center of the engagement plate 20 longitudinally of the base plate 2. The engagement plates 20 of the engagement projections 21 are respectively brought into engagement with the engagement holes 18 by moving the base plate 2 along the length thereof. The other construction is the same as in the second and third embodiments.

In the fourth embodiment, the engagement plates 20 of the engagement projections 21 and the engagement holes 18 each have a round shape. However, the shapes of the engagement plates 20 and the engagement holes 18 are not particularly limited, but may be square, rectangular, triangular or oval.

Although the engagement holes 18 are formed in the spine 10 of the file cover 7 so that the binding member 1 is fixed onto the spine 10 in the second, third and fourth embodiments and the modifications thereof, the engagement holes 18 may be formed in at least one of the front and back cover portions 8, 9 in the vicinity of the spine 10 so that the binding member 1 is fixed onto the at least one cover portion 8, 9.

Further, any of the second, third and fourth embodiments and the modifications thereof may be employed in combination with the first embodiment, in which the hooks 6 are provided at the longitudinally opposite ends of the base plate 2 of the binding member 1 as extending outwardly therefrom in a U-shape. For example, an engagement projection 21 is provided at a longitudinally middle position on the back side of the base plate 2 of the binding member 1 formed with the U-shaped hooks 6 extending outwardly from the longitudinally opposite ends of the base plate 2. With this arrangement, the binding member 1 can be fixed onto the file cover 7 with the hooks being hooked onto the longitudinally opposite ends of the spine 10 or onto opposite edges of at least one of the front and back cover portions 8, 9 in the vicinity of the spine 10 and with the engagement projection 21 being fitted in an engagement hole 18 formed in the file cover 7.

What is claimed is:

1. A filing device for removably binding a plurality of folder bags of a synthetic resin each having engagement portions provided as incisions in an edge portion thereof at predetermined intervals, the filing device comprising:

a file cover including a front cover portion, a back cover portion, and a spine provided between the front and back cover portions; and a binding member including an elongated base plate, a plurality of binding elements provided parallel to each other at the predetermined intervals along the length of the base plate on an inner side of the base plate as projecting perpendicularly to the base plate, and a pair of hooks extending outwardly from longitudinally opposite ends of the base plate in a U-shape, the binding member being a unitary component formed of a synthetic resin;

wherein the binding member is fixed onto an inner side of the file cover along a longitudinal edge of the spine with the pair of hooks being hooked onto opposite edges of the file cover in the vicinity of the longitudinal edge of the spine;

wherein the binding elements of the binding member respectively have generally inverted-U-shaped flanges which are engageable with the engagement portions of the folder bags.

2. A filing device as set forth in claim 1, wherein the binding member is fixed onto an inner side of the spine of the file cover with the pair of hooks being hooked onto longitudinally opposite ends of the spine.

3. A filing device as set forth in claim 1, wherein the binding member is fixed onto an inner side of at least one of the front and back cover portions of the file cover along the longitudinal edge of the spine with the pair of hooks being hooked onto opposite edges of the at least one cover portion in the vicinity of the longitudinal edge of the spine.

4. A filing device as set forth in claim 2, wherein the spine of the file cover has a pair of cut-away portions provided at the longitudinally opposite ends thereof and having the same width as the base plate of the binding member, wherein the binding member is fixed onto the inner side of the spine with the pair of hooks being respectively fitted in the pair of cut-away portions.

5. A filing device as set forth in claim 3, wherein the at least one cover portion of the file cover has a pair of cut-away portions provided on the opposite edges thereof in the vicinity of the longitudinal edge of the spine and having the same width as the base plate of the binding member, wherein the binding member is fixed onto the inner side of the at least one cover portion of the file cover along the longitudinal edge of the spine with the pair of hooks being respectively fitted in the pair of cut-away portions.

6. A filing device as set forth in claim 2, wherein the spine of the file cover is formed with at least one engagement hole which has a hole portion and a linear slot extending from the hole portion parallel to the longitudinal edge of the spine and having a smaller width than the hole portion, wherein the base plate of the binding member has at least one engagement projection projecting from an outer side thereof, the engagement projection having a stem fitted in the linear slot of the engagement hole of the spine and an engagement plate provided at a distal end of the stem and having a width smaller than the width of the hole portion and greater than the width of the linear slot, wherein the binding member is fixed onto the inner side of the spine of the file cover with the pair of hooks being respectively hooked onto the longitudinally opposite ends of the spine and with the engagement projection of the binding member being fitted in the engagement hole of the spine.

7. A filing device as set forth in claim 3, wherein the at least one cover portion of the file cover has at least one engagement hole formed therein in the vicinity of the longitudinal edge of the spine, the engagement hole having a hole portion and a linear slot extending from the hole portion parallel to the longitudinal edge of the spine and having a smaller width than the hole portion, wherein the base plate of the binding member has at least one engagement projection projecting from an outer side thereof, the engagement projection having a stem fitted in the linear slot of the engagement hole of the at least one cover portion and an engagement plate provided at a distal end of the stem and having a width smaller than the width of the hole portion and greater than the width of the linear slot, wherein the binding member is fixed onto the inner side of the at least one cover portion of the file cover along the longitudinal edge of the spine with the pair of hooks being respectively hooked onto the opposite edges of the at least one cover portion in the vicinity of the longitudinal edge of the spine and with the engagement projection of the binding member being fitted in the engagement hole of the at least one cover portion.

8. A filing device as set forth in claim 6 or 7, wherein the linear slot of the engagement hole extends from the center of the hole portion parallel to the longitudinal edge of the spine.

9. A filing device as set forth in claim 6 or 7, wherein the hole portion of the engagement hole is of a round shape, and the linear slot of the engagement hole extends tangentially from the hole portion parallel to the longitudinal edge of the spine.

10. A filing device as set forth in claim 2, wherein the spine of the file cover is formed with at least one engagement hole, wherein the base plate of the binding member has at least one engagement projection projecting from an outer side thereof, the engagement projection having a stem and an engagement plate provided at a distal end of the stem and having a width smaller than the width of the engagement hole of the spine and greater than the width of the stem, wherein the binding member is fixed onto the inner side of the spine of the file cover with the engagement projection of the binding member engaged with the engagement hole of the spine by movement of the base plate and with the pair of hooks being respectively hooked onto the longitudinally opposite ends of the spine.

11. A filing device as set forth in claim 3, wherein the at least one cover portion of the file cover has at least one engagement hole formed therein in the vicinity of the longitudinal edge of the spine, wherein the base plate of the binding member has at least one engagement projection projecting from an outer side thereof, the engagement projection having a stem and an engagement plate provided at a distal end of the stem and having a width smaller than the width of the engagement hole of the at least one cover portion and greater than the width of the stem, wherein the binding member is fixed onto the inner side of the at least one cover portion of the file cover along the longitudinal edge of the spine with the engagement projection of the binding member engaged with the engagement hole of the at least one cover portion by movement of the base plate and with the pair of hooks being respectively hooked onto the opposite edges of the at least one cover portion in the vicinity of the longitudinal edge of the spine.

12. A filing device for removably binding a plurality of folder bags of a synthetic resin each having engagement portions provided as incisions in an edge portion thereof at predetermined intervals, the filing device comprising:

a file cover including a front cover portion, a back cover portion, and a spine provided between the front and back cover portions, the file cover having a plurality of engagement holes formed therein alongside a longitudinal edge of the spine, the engagement holes each having a hole portion and a linear slot extending from the hole portion parallel to the longitudinal edge of the spine and having a smaller width than the hole portion; and a binding member including an elongated base plate, a plurality of binding elements provided parallel to each other at the predetermined intervals along the length of the base plate on an inner side of the base plate as projecting perpendicularly to the base plate, and a plurality of engagement projections provided on an outer side of the base plate along the length of the base plate, the binding member being a unitary component formed of a synthetic resin, the engagement projections each having a stem fitted in the linear slot of the engagement hole and an engagement plate provided at a distal end of the stem and having a width smaller than the width of the hole portion and greater than the width of the linear slot;

wherein the binding member is fixed onto an inner side of the file cover along the longitudinal edge of the spine with the engagement projections being respectively fitted in the engagement holes;

wherein the binding elements of the binding member respectively have generally inverted-U-shaped flanges which are engageable with the engagement portions of the folder bags.

13. A filing device as set forth in claim 12, wherein the plurality of engagement holes are formed in the spine of the file cover along the length thereof, wherein the binding member is fixed onto an inner side of the spine.

14. A filing device as set forth in claim 12, wherein the plurality of engagement holes are formed in at least one of the front and back cover portions of the file cover alongside the longitudinal edge of the spine, wherein the binding member is fixed onto an inner side of the at least one cover portion along the longitudinal edge of the spine.

15. A filing device as set forth in any of claims 12 to 14, wherein the linear slot of the engagement hole extends from the center of the hole portion parallel to the longitudinal edge of the spine.

16. A filing device as set forth in any of claims 12 to 14, wherein the hole portion of the engagement hole is of a round shape, and the linear slot of the engagement hole extends tangentially from the hole portion parallel to the longitudinal edge of the spine.

17. A filing device for removably binding a plurality of folder bags of a synthetic resin each having engagement portions provided as incisions in an edge portion thereof at predetermined intervals, the filing device comprising:

a file cover including a front cover portion, a back cover portion, and a spine provided between the front and back cover portions, the file cover having a plurality of engagement holes formed therein alongside a longitudinal edge of the spine; and a binding member including an elongated base plate, a plurality of binding elements provided parallel to each other at the predetermined intervals along the length of the base plate on an inner side of the base plate as projecting perpendicularly to the base plate, and a plurality of engagement projections provided on an outer side of the base plate along the length of the base plate, the binding member being a unitary component formed of a synthetic resin, the engagement projections each having a stem and an engagement plate provided at a distal end of the stem and having a width smaller than the width of the engagement hole and greater than the width of the stem;

wherein the binding member is fixed onto an inner side of the file cover along the longitudinal edge of the spine with the engagement projections respectively engaged with the engagement holes by movement of the base plate;

wherein the binding elements of the binding member respectively have generally inverted-U-shaped flanges which are engageable with the engagement portions of the folder bags.

18. A filing device as set forth in claim 17, wherein the plurality of engagement holes are formed in the spine of the file cover along the length thereof, wherein the binding member is fixed onto an inner side of the spine.

19. A filing device as set forth in claim 17, wherein the plurality of engagement holes are formed in at least one of the front and back cover portions of the file cover alongside the longitudinal edge of the spine, wherein the binding member is fixed onto an inner side of the at least one cover portion along the longitudinal edge of the spine.

* * * * *